US006426323B1

(12) United States Patent
Sato et al.

(10) Patent No.: US 6,426,323 B1
(45) Date of Patent: Jul. 30, 2002

(54) LUBRICATING OIL COMPOSITION FOR CONTINUOUSLY VARIABLE TRANSMISSION

(75) Inventors: Takehisa Sato, Chiba; Takanori Kugimiya, Saitama, both of (JP)

(73) Assignee: TonenGeneral Sekiyu K.K., Saitama (JP)

( * ) Notice: Subject to any disclaimer, the term of this patent is extended or adjusted under 35 U.S.C. 154(b) by 0 days.

(21) Appl. No.: 09/874,851

(22) Filed: Jun. 5, 2001

(51) Int. Cl.[7] ..... C10M 141/10

(52) U.S. Cl. ..... 508/371; 508/372; 508/378; 508/403; 508/408; 508/421; 508/438; 508/442

(58) Field of Search ..... 508/371, 372, 508/378, 403, 408, 421, 438, 442

(56) References Cited

U.S. PATENT DOCUMENTS 5,750,477 A * 5/1998 Sumiejski et al. ..... 508/331
5,840,663 A * 11/1998 Nibert et al. ..... 508/291
5,922,656 A * 7/1999 Yoshimura et al. ..... 508/402
6,010,988 A * 1/2000 Matsuoka et al. ..... 508/372
6,184,185 B1 * 2/2001 Taguchi et al. ..... 508/192
6,226,266 B1 * 5/2001 Watts et al. ..... 508/193
6,262,000 B1 * 7/2001 Reeve et al. ..... 508/371

FOREIGN PATENT DOCUMENTS

EP 1055722 * 11/1999

* cited by examiner

*Primary Examiner*—Jacqueline V. Howard
(74) *Attorney, Agent, or Firm*—Linda M. Scuorzo

(57) ABSTRACT

To provide a lubricating oil composition for continuously variable transmission which ensures both a high coefficient of friction between metals required for a push belt-type CTV oil and an excellent wear preventing property relative to a belt and a pulley. A lubricating oil composition for continuously variable transmission is provided, which comprises a lubricating base oil made of a mineral oil and/or a synthetic oil formulated with a metal detergent and a phosphorus-based wear preventive characterized in that a ratio between a content (ppm) of a metal derived from said metal detergent and based on the total weight of the lubricating oil composition and a total base number (mg KOH/g) ranges 0.75–4.5 (ppm/mg KOH/g), and a ratio between the content (ppm) of the metal derived from said metal detergent and a content of phosphorus derived from said phosphorus-based wear preventive ranges 0.5–2.0 (ppm/ppm).

1 Claim, No Drawings

LUBRICATING OIL COMPOSITION FOR CONTINUOUSLY VARIABLE TRANSMISSION

FIELD OF THE INVENTION

This invention relates to a lubricating oil composition for continuously variable transmission, and more particularly, to a lubricating oil composition used in a push belt type of continuously variable transmission. More specifically, the invention relates to a lubricating oil composition which ensures a high coefficient of boundary lubrication friction and an excellent wear preventing property in a push belt-type continuously variable transmission.

BACKGROUND OF THE INVENTION

The push belt-type continuously variable transmission (which may be sometimes referred to as belt-type CVT hereinafter) rapidly increases in number because it is effective in improving a fuel cost and also drivability of automobiles. However, the belt-type CVT is difficult in obtaining a large transmission torque capacity, and has been mounted only on a small automobile whose displacement is 1600 cc or below. The improvement in the transmission torque capacity is a serious problem on the belt-type CVT.

With the belt-type CVT, a torque is transmitted by means of a friction force between a belt element and a pulley. Thus, the transmission torque capacity is determined depending on the coefficient of friction between the metals of the belt element and the pulley and the urging force of the pulley. The coefficient of friction between the metals is influenced by the property of a lubricating oil. The shortage of the coefficient of friction between the metals may lead to the slippage between the belt and the pulley and may cause a disadvantage in that the belt is broken out.

On the other hand, an electromagnetic clutch has been hitherto used as a starting mechanism of the belt-type CVT. In order to cope with an increasing transmission torque accompanied by the tendency toward a great displacement and improve the drivability, there has been now used a wet clutch or and a torque converter with a lock-up clutch. These wet clutch, torque converter and CVT make use of a common lubricating oil. Accordingly, it has become important how to adapt the lubricating oil for continuously variable transmission (CVT oil) to the wet clutch or torque converter.

Under these circumstances, an automatic transmission oil (referred to as ATF) has been frequently used for the CTV oil. This is because with an existing automobile of a small displacement, the transmission torque is so small that a required level of the coefficient of friction between metals is not so high, under which if an oil having a relatively high coefficient of friction between metals is selected among ATF's, the performance can be satisfied. The merit of making use of ATF includes actual results on the adaptability with a wet clutch and also on adaptability on other types of materials. However, if the belt-type CVT is mounted in an automobile of a large displacement, a required level of the coefficient of friction between metals increases. The mere use of ATF does not result in a satisfactory performance, and an oil only for the CVT has to be used.

Further, in order to efficiently transmit an engine output by means of the belt-type CVT, it is necessary to prevent slippage between a belt and a pulley. When a belt for preventing the slippage is inserted at an increased pressure, it is more liable to wear out. To avoid this, there has been required not only an improvement in device, but also a lubricating oil that can prevent the slippage between a belt and a pulley and can also prevent the belt and pulley from being worn out.

Hitherto, lubricating oils for continuously variable transmission have been proposed including, for example, a lubricating oil composition of Japanese Patent Application Laid-open No. Hei 2-175794 wherein a wear preventive, a metal detergent and a carboxyl group-bearing friction modifier are formulated, a composition for continuously variable transmission of Japanese Patent Application Laid-open No. Hei 9-100487 wherein a sulfur-based extreme pressure agent, a phosphorus-based extreme pressure agent, and a metal-based detergent are formulated, a lubricating oil composition for continuously variable transmission of Japanese Patent Application Laid-open No. Hei 10-8081 wherein an ashless dispersant, a sulfur-based extreme pressure agent and a phosphorus-based extreme pressure agent are formulated, a lubricating oil composition for belt-type CVT automatic transmission of Japanese Patent Application Laid-open No. Hei 10-306292 wherein a Ca sulfonate and a phosphite ester having a specified range of a total base number are formulated, a lubricating oil composition for belt-type continuously variable transmission of Japanese Patent Application Laid-open No. Hei 11-80772 which has a coefficient of friction within a specified range and wherein a metal detergent and a zinc dialkyldithiophosphate are formulated, and a lubricating oil composition for continuously variable transmission of Japanese Patent Application Laid-open No. Hei 11- 181464 wherein a polymethacrylate or the like, an imide compound and a zinc alkyldithiophosphate are formulated. In spite of these proposals, however, a satisfactory, high level of a coefficient of friction between metals and an excellent wear preventing property against the belt and pulley have not be realized. Especially, a high coefficient of friction between metals is required for the belt-type continuously variable transmission lubricating oil (CVT oil) is required, for which a metal detergent is formulated. Among metal detergents, there are known some detergents that impede the wear preventing property depending on the amount thereof. On the other hand, a wear preventive formulated to improve the wear preventing property is unsatisfactory for wear proofing owing to the interaction with the metal detergent if its amount is too small. In contrast, when the amount is too much, there arises the problem that a coefficient of friction between metals lowers.

Applicants invention addresses the needs with respect to such lubricating oils.

SUMMARY OF THE INVENTION

Embodiments of the invention relate to a lubricating oil composition wherein at least two specific types of compounds are formulated in a lubricating base oil.

The lubricating oil compositions have both a high coefficient of friction between metals and an enhanced wear preventing property against a belt and a pulley as required for a belt-type CVT oil.

Applicants have found that when at least two additives including a metal detergent (A) having a ratio of a metal content and a total base number within a specified range, and a phosphorus-based wear preventive (B) are formulated in a lubricating base oil in such a way that a ratio between the metal content in the metal detergent (A), i.e. a calcium content, and a phosphorus content in the phosphorus-based wear preventive (B) is within a specified range, whereby a lubricating oil composition for continuously variable transmission which can realize both a high coefficient of friction between metals and an excellent wear preventing property required as the lubricating oil for continuously variable transmission can be obtained.

More particularly, according to an embodiment of the invention, there is provided a lubricating oil composition for continuously variable transmission, which comprises a metal detergent (A) and a phosphorus-based wear preventive (B), characterized in that a ratio between a content (ppm) of a metal derived from said metal detergent (A) and based on the total weight of the lubricating oil composition and a total base number (mg KOH/g) ranges 0.75–4.5 (ppm/mg KOH/g), and a ratio between the content (ppm) of the metal derived from said metal detergent (A) and a content of phosphorus derived from the phosphorus-based wear preventive (B) ranges 0.5–2.0 (ppm/ppm).

Preferred embodiments include those set forth below.

(1) A lubricating oil composition for continuously variable transmission, wherein a continuously variable transmission is a push belt-type continuously variable transmission.

(2) A lubricating oil composition for continuously variable transmission, wherein the phosphorus-based wear preventive is made of at least one phosphorus-based wear preventive selected from an acid phosphate ester, an acid phosphite ester and phosphoric acid.

(3) A lubricating oil composition for continuously variable transmission, wherein the phosphorus-based wear preventive is made of a zinc dialkyldithiophosphate whose alkyl groups are primary, secondary or a mixture thereof or a thiophosphate ester.

(4) A lubricating oil composition for continuously variable transmission, wherein the metal detergent has a total base number of 400 mg KOH/g or below.

(5) A lubricating oil composition for continuously variable transmission, characterized in that the metal detergent is made of an alkaline earth metal salt of an alkylbenzene or alkylnaphthalenesulfonic acid, an alkaline earth metal salt of an alkylphenol sulfide or an alkaline earth metal salt of an alkylsalicyclic acid.

The present invention may comprise, consist or consist essentially of the elements or steps herein and may be practiced in the absence of a limitation disclosed as required, and includes the products produced by the processes herein.

DETAILED DESCRIPTION OF THE PREFERRED EMBODIMENTS

Embodiments of the invention is described in more detail below.

Lubricating base oil

The base oil used in the lubricating oil composition for continuously variable transmission of the invention is not critical in type, for which any ones ordinarily used as a lubricating base oil may be employed. More particularly, oils falling under this category include mineral oils, synthetic oils or mixed oils thereof.

The base oil used in the practice of the invention should have a kinematic viscosity, at 100° C., ranging 0.5–200 $mm^2/s$, preferably 2–25 $mm^2/s$, and more preferably 3.5–8 $mm^2/s$. If the kinematic viscosity of the base oil is too high, the viscosity at a low temperature becomes poor. In contrast, when the kinematic viscosity is too low, there arise the problems that a wear may occur at a sliding portion of a continuously variable transmission and that a flash point becomes low.

The mineral oil consists of a hydrocarbon oil fraction having a lubricating oil viscosity. For example, there may be used a hydrocarbon oil, which is obtained by treating a vacuum distillate with an aromatic extraction solvent, such as phenol, furfural or N-methylpyrrolidone to obtain a raffinate, subsequently subjecting the raffinate to dewaxing with a solvent such as propane, methyl ethyl ketone or the like and, if necessary, further subjecting to hydro-refining to obtain a hydrocarbon oil, or a mixture of this hydrocarbon distillate oil with a residual oil obtained after the solvent extraction, dewaxing with a solvent and deasphalting with a solvent. From the standpoint of oxidation stability, it is preferred that the ratio of the aromatic carbon atoms to the total carbon atoms $\%C_A$ (method of D3238 in ASTM) is 20 or below, more preferably 10 or below. From the standpoint of a pour point, the pour point should preferably be at −10° C. or below, more preferably at −15° C. or below. These refined mineral oils may be compositionally made of paraffin, naphthene and like oils, and may be used singly or may be made of a mixed hydrocarbon thereof. Specific examples of the mineral oils include light neutral oils, medium neutral oils, heavy neutral oils and bright stocks, which are appropriately mixed so as to satisfy required properties, thereby preparing a base oil.

The synthetic oils used in the invention include olefin oligomers, dibasic acid esters, polyol esters, polyalkylene glycols, polyethers, alkylbenzenes, alkylnaphthalenes and the like.

The olefin oligomer is selected from those products that are obtained by homopolymerizing an arbitrary one selected from linear or branched olefins having 2–14 carbon atoms, preferably from 4–12 carbon atoms or by copolymerizing two or more olefins, with an average molecular weight raging 100 –about 3,000, preferably 200 –about 1,000. Preferably, those products wherein unsaturated bonds are removed through hydrogenation are preferred. Preferred examples of the olefin oligomer include polybutene, α-olefin oligomers, ethylene α-olefin oligomers and the like.

The dibasic acid esters include esters of aliphatic dibasic acids having 4–14 carbon atoms and aliphatic alcohols having 4–14 carbon atoms. The polyesters include esters of polyhydric alcohols such as neopentyl glycol, trimethylolpropane, pentaerythritol and the like and aliphatic acids having 4–18 carbon atoms. In addition, esters of hydroxy acids such as hydroxypivalic acid, aliphatic acids and alcohols may also be used.

Examples of the polyoxyalkylene glycols include polymerized products of alkylene oxides having 2–4 carbon atoms. The alkylene oxides may be polymerized singly or in admixture thereof. The polymer of a mixture of alkylene oxides may be either a block polymer or a random polymer. The alkylene glycol may be blocked with an ether or ester at one or both ends thereof. Phenyl ether or the like may be used as the polyether.

These base oils may be used singly or in combination of two or more, and a mineral oil and a synthetic oil may be used in combination.

Additive components

Next, the essential components (A) and (B) used in the lubricating oil composition of the invention are described.

The metal detergent used as the component (A) in the lubricating oil composition of the invention should have an alkaline earth metal or an alkali metal in the molecule and should be dissolved or uniformly dispersed in a lubricating base oil. The detergent should have a ratio between a content (ppm) of a metal derived from the metal detergent and based on the total weight of the lubricating oil composition and a total base number (mg KOH/g) ranging 0.75–4.5 (ppm/mg KOH/g). When the ratio between the metal content (ppm)

and the total base number (mg KOH/g) is less than 0.75 (ppm/mg KOH/g), the coefficient of friction between metals becomes insufficient. On the other hand, when the ratio exceeds 4.5 (ppm/mg KOH/g), the wear preventing property becomes unsatisfactory.

Such a metal detergent includes, for example, an alkaline earth metal salicylate, carboxylate, sulfonate, phenate or phosphonate having at least one chain hydrocarbon group. Specific examples include alkaline earth metal salts of alkylsalicylic acids, alkaline earth metal salts of naphthenic acid or phthalic acid having a substituent such as an alkyl group, alkaline earth metal salts of petroleum sulfonic acid, alkylbenzenesulfonic acids or alkylnaphthalenesulfonic acids, alkaline earth metal salts alkylphenol sulfides or alkaline earth metal salts of thiophosphonic acid or phosphonic acid having a hydrocarbon group. Calcium (Ca) salts, magnesium (Mg) salts and barium (Ba) salts are favorably used. Alternatively, alkali metal salicylates, carboxylates, sulfonates, phenates or phosphonates may also be used. Sodium (Na) or potassium (K) are used as the alkali metal. Of these, it is preferred from the standpoint of the effectiveness to use an alkaline earth metal salicylate or sulfonate.

These metal detergents should generally have a total base number (TBN) [JIS K2501 (perchloric acid method)] ranging 10–450 mg KOH/g, preferably 100–400 mg KOH/g. With respect to a soap content, those having a content of 20–50 wt %, preferably 30–45 wt %, are usable.

The amount of the metal detergent is preferably in the range of 100–1000 ppm as a metal content based on the total weight of the composition. If the metal amount is less than 100 ppm, the action of improving the coefficient of friction between metals is not significant. On the other hand, when the content exceeds 1000 ppm, oxidation stability deteriorates. As stated hereinabove, the metal detergent should have a ratio between the metal content (ppm) relative to the total weight of the lubricating oil composition and the total base number (mg KOH/g) within a range of 0.75–4.5 (ppm/mg KOH/g), and may be used singly or in combination of two or more. If two or more are used, the ratio between the metal content (ppm) and the total base number (mg KOH/g) is calculated from a sum of the values derived from individual metal detergents. For instance, where Ca sulfonate (formulated at 300 ppm as Ca) having a TBN of 300 mg KOH/g and Ca salicylate (formulated at 500 ppm as Ca) having a TBN of 170 mg KOH/g are used in combination, a ratio between the metal content (ppm) and the total base number (mg KOH/g) is 1 +2.94 =3.94 (ppm/mg KOH/g).

The phosphorus-based wear preventive used as component (B) in the lubricating oil composition of the invention includes a phosphorus-based wear preventing agent such as phosphoric acid, phosphate esters, acid phosphate esters, thiophosphate esters (thiophosphate, dithiophosphate and the like), acid thiophosphate esters, phosphite esters, acid phosphite esters, thiophosphite esters (trithiophosphite and the like), acid thiophosphite esters, phosphonates, acid phosphonates, acid phosphate ester amine salts, acid phosphite ester amine salts, acid thiophosphate ester amine salts, acid thiophosphite ester amine salts, acid phosphonate amine salts, or the like. It will be noted that in the phosphate or phosphite esters, sulfur (S) may be contained in the alkyl group. Alternatively, zinc dialkyldithiophosphates (ZnDTP) whose alkyl groups are primary, secondary or a mixture thereof may be used. Of these, acid phosphate esters, acid phosphite esters phosphoric acid or mixtures thereof are preferably used.

The amount of the phosphorus-based wear preventive is generally within a range of 100–500 ppm as phosphorus (P) based on the total weight of the composition. From the standpoint of the effect on the coefficient of friction between metals and the wear preventing property, the ratio between the content (ppm) of the metal derived from the metal detergent serving as component (A) and the content (ppm) of the phosphorus derived from the phosphorus-based wear preventive should be within a range of 0.5–2.0 (ppm/ppm). In this sense, the amount is preferably within a range of 0.5–1.8 (ppm/ppm). If the ratio between the content (ppm) of the metal derived from the metal detergent serving as component (A) and the content (ppm) of the phosphorus derived from the phosphorus-based wear preventive is less than 0.5 (ppm/ppm), the coefficient of friction between metals becomes unsatisfactory. On the other hand, when the ratio exceeds 2.0 (ppm/ppm), the wear preventing property becomes unsatisfactory.

The lubricating oil composition of the invention, which comprises these two types of additives as essential components, is employed as a lubricating oil for continuously variable transmission, such remarkable effects are achieved that a high coefficient of friction between metals and an excellent wear preventing property against a belt and a pulley, both required as a lubricating oil for continuously variable transmission, can be realized.

Other Additive Components

The lubricating oil composition of the invention comprises, as essential components, such compounds as set forth hereinabove formulated in a lubricating base oil. If necessary, various types of additives ordinarily used in ATF may be appropriately added to within ranges not impeding the purposes of the invention, including a friction modifier, an ashless dispersant, a metal deactivator, an antioxidant, a viscosity index improver, a pour point depressant, an antifoam agent, an antirustisng agent, a colorant and the like.

As a friction modifier, there are conveniently used an amine friction modifier and a boron-containing friction modifier. Alternatively, amide compounds, imide compounds, boron-containing cyclic carboxylic acid imides and the like may be beneficially used. Examples of the amine friction modifier include alkylamines, alkyldiamines, dialkylamines or trialkylamines having 4–36 carbon atoms. Preferably, an alkylamine or a dialkylamine is used. For the boron-containing alcohol friction modifier, there are used aliphatic monoalcohols, aliphatic polyvalent alcohols or reaction products of alkylene glycols and boric acid. The amount of the friction modifier is preferably 0.01–5 wt % based on the total weight of the composition. If the amount is less than 0.01 wt %, a desired effect is not shown. On the other hand, when the amount exceeds 5 wt %, the coefficient of friction between metals lowers.

The ashless dispersant includes imide compounds such as a monoimide, a bisimide and the like. Preferably, a succinimide or a products obtained by treating a succinimide with a boron compound is used. The boron-containing compound of a polyalkyl or polyalkenylsuccinimide is more preferred. These are generally used in an amount of 0.1–10 wt %.

The deactivator for metal includes benzotriazole, thiadiazole and derivatives thereof. The combination of compounds of the benzothiazole type and the thiadiazole type are preferred because of the remarkable improvement in oxidation stability caused by the combination. These are usually used in an amount of 0.001–3 wt %.

Preferred antioxidants include hindered phenols and amines. The use in combination of these is preferred because of the remarkable improvement in oxidation stability. Favorable phenolic antioxidants include 4-methyl-2,6-ditertiary butylphenol, 4,4-methylene-bis-2,6-ditertiary butylphenol and the like. The amine antioxidants include phenyl-α-naphthylamine, an alkylphenyl-α-diphenylamine, diphenylamine, an alkyldiphenylamine and the like. These are usually employed in an amount of 0.05–5 wt %.

A dispersion-type viscosity index improver can be favorably used as a viscosity index improver. Especially, a polyacrylate is preferred. More preferably, those containing about 5–20 mole % of a polar monomer are more preferred. As the polar monomer, there can be conveniently used amines such as diethylaminoethyl methacrylate, 2-methyl-5-vinylpyridine, and nitrogen-containing compounds such as N-vinylpyrrolidinone. With respect to the molecular weight of the dispersion-type viscosity index improver, those improvers having a number average molecular weight of 5,000–200,000 can be used, and the number average molecular weight of 100,000 or below is preferred from the standpoint of shear stability. The amount of the dispersion-type viscosity index improver is preferably within a range of 1–7 wt % based on the total weight of the composition. If the amount is less than 1%, the effect of improving oxidation stability is reduced. On the other hand, when the amount exceeds 7%, oxidation stability may deteriorate, instead. Other types of viscosity index improver may be used in combination. Usable viscosity index improvers include an olefin copolymer such as an ethylene-propylene copolymer or the like, a polyacrylate, a polymethacrylate or the like. In view of its low temperature viscosity, a polymethacrylate is preferably used. These are usually used in an amount of 1–20 wt %.

The pour point depressant usually includes an ethylene-vinyl acetate copolymer, a condensate of chlorinated paraffin and naphthalene, a condensate of chlorinated paraffin and phenol, a polymethacrylate, a polyakylstyrene or the like. These are generally used in an amount of 0.01–5 wt %.

An antifoam agent includes a silicone compound such as dimethylpolysiloxane or the like, sorbitan monolaurate, or an ester compound such as an alkenylsuccinic acid derivative. These are usually used in an amount of 0.0001–2 wt %.

Further, a corrosion inhibitor, a colorant and the like additives may be used in the lubricating oil composition of the invention, if desired.

Examples of the belt-type CVT useful in the present invention include a CVT using a metallic belt manufactured by Van Doorne' Transmissie BV Corp. In the practice of the invention, the belt-type CVT is not limited to such a CVT using the belt manufactured by Van Doorne' Transmissie BV Corp., and the composition can be applied to a similar mechanism, i.e. a CVT capable of transmitting power by use of friction between metals.

EXAMPLES

The invention is described in more detail by way of examples and comparative examples. The invention should not be construed as limiting to these examples. It will be noted that the method of measuring a coefficient of friction between metals and a method for evaluating a wear preventing property in examples and comparative example were conducted in the following manner.

(1) Coefficient of Friction Between Metals

An SRV friction testing machine (reciprocating friction testing machine) was used as a testing machine, and the test was conducted under the following conditions to measure an initial coefficient of friction between metals (i.e. a maximum value of a coefficient of friction between metals immediately after commencement of sliding). A sample having a coefficient of friction between metals of 0.15 or over was judged as acceptable.

Test conditions

Test piece: ball (SUJ2), plate (SUJ2)

Test temperature: 100 ° C.

Load: 100 N

Frequency: 50 Hz

Stroke: 1 mm

(2) Wear Preventing Property (Shell-type Four-ball Wear Test)

In order to evaluate a wear preventing property of a lubricating oil, a Shell-type four-ball testing machine was used, and the test was conducted according to a tentative method of ASTM D 2266 under the following testing conditions to measure a diameter of a wear mark. The diameter of 0.55 mm or below was judged as acceptable.

Test conditions

Test piece: ball (SUJ2)

Test temperature: 80 ° C.

Test time: 30 minutes

Number of revolutions: 1800 r.p.m.

Load: 35 kgf

(3) Examples and Comparative Examples

Example 1

A solvent-refined paraffin mineral oil (having a kinematic viscosity of 4 $mm^2/s$ at 100° C.) was used as a base oil. The base oil was formulated, based on the total weight of a composition, with Ca sulfonate serving as a metal detergent of component (A) with a total base number (TBN) of 300 mg KOH/g and used in an amount of 250 ppm as Ca, (monoalkyl/dialkyl mixed) acid phosphate serving as a phosphorus-based wear preventive of component (B) in an amount of 500 ppm as P, and 10.0 wt %, in total, of other additives including a friction modifier, an ashless dispersant, an antioxidant, a viscosity index improver, a metal deactivator and an antifoam agent, each in a given amount, thereby preparing a lubricating oil composition.

The thus prepared lubricating oil composition was subjected to measurement of a coefficient of friction between metals and evaluation of a wear preventing property. The results are shown in Table 1. The coefficient of friction between metals in Example 1 was found to be 0.170, and the wear preventing property, i.e. the wear mark diameter determined by the Shell-type four-ball wear test, was at 0.52 mm and was thus good.

Example 2–6

Similar to Example 1, the base oil component and additive components indicated in Table 1 were formulated at such ratios as indicated in the table to prepare lubricating oil compositions. The thus prepared lubricating oil compositions were each subjected to measurement of a coefficient of friction between metals and also to evaluation of the wear preventing property. These results are shown in Table 1. Like Example 1, the results of the evaluation in Examples 2–6 were good.

TABLE 1

| | Example 1 | Example 2 | Example 3 | Example 4 | Example 5 | Example 6 |
|---|---|---|---|---|---|---|
| Composition | | | | | | |
| Base oil*1 | Balance | Balance | Balance | Balance | Balance | Balance |
| (A) | | | | | | |
| Ca sulfonate*2 amount of Ca (ppm) | 250 | 500 | — | 500 | — | — |
| Ca sulfonate*3 amount of Ca (ppm) | — | — | 130 | — | — | — |
| Ca salicylate*4 amount of Ca (ppm) | — | — | | — | 500 | — |
| Mg sulfonate*5 amount of Ca (ppm) | — | — | — | — | — | 500 |
| TBN of metal detergent (mg KOH/g) | 300 | 300 | 30 | 300 | 170 | 400 |
| Metal (Ca or Mg)/TBN (ppm/mg KOH/g) | 0.83 | 1.67 | 4.33 | 1.67 | 2.94 | 1.25 |
| (B) | | | | | | |
| Phosphorus-based wear preventive*6 amount of P (ppm) | 350 | 350 | 250 | — | 350 | 350 |
| ZnDTP*7 amount of P (ppm) | — | — | — | 300 | — | — |
| Metal (Ca or Mg)/P (ppm/ppm) | 0.71 | 1.43 | 0.52 | 1.67 | 1.43 | 1.43 |
| Other additives*8 (wt %) | 10.0 | 10.0 | 10.0 | 10.0 | 10.0 | 10.0 |
| Coefficient of friction between metals | 0.170 | 0.172 | 0.165 | 0.178 | 0.176 | 0.175 |
| Wear preventing property (Shell-type four-ball test-wear) | | | | | | |
| • wear mark diameter (mm) @ 1800 rpm, 80° C., 30 min., 35 kgf | 0.52 | 0.54 | 0.54 | 0.50 | 0.52 | 0.53 |

*1Solvent-refined paraffin mineral oil (kinematic viscosity of 4 $mm^2/s$ at 100° C.)
*2Ca alkylbenzenesulfonate with a total base value of 300 mg KOH/g
*3Ca alkylbenzenesulfonate with a total base value of 30 mg KOH/g
*4Ca alkylbenzenesalicylate with a total base value of 170 mg KOH/g
*5Mg alkylbenzenesulfonate with a total base value of 400 mg KOH/g
*6(monoalkyl/dialkyl mixed) acid phosphate
*7secondary alkyl ZnDTP
*8Wear preventive, ashless dispersant, antioxidant, viscosity index improver, metal deactivator, and antifoam agent added to as other additives each in a given amount

Comparative Examples 1–5

The lubricating base oil component and various types of additive components indicated in Table 1 were, respectively, formulated at such ratios indicated in the table, thereby preparing lubricating oil compositions. The thus prepared lubricating oil compositions were, respectively, subjected to measurement of a coefficient of friction between metals and also to evaluation of the wear preventive property. The results are shown in Table 2.

TABLE 2

| | Comp. Ex. 1 | Comp. Ex. 2 | Comp. Ex. 3 | Comp. Ex. 4 | Comp. Ex. 5 |
|---|---|---|---|---|---|
| Composition | | | | | |
| Base oil*1 | Balance | Balance | Balance | Balance | Balance |
| (A) | | | | | |
| Ca sulfonate*2 amount of Ca (ppm) | 100 | 1500 | — | — | — |
| Ca sulfonate*3 amount of Ca (ppm) | — | — | 240 | 240 | 240 |
| Ca salicylate*4 amount of Ca (ppm) | — | — | — | — | — |
| Mg sulfonate*5 amount of Ca (ppm) | — | — | — | — | — |
| TBN of metal detergent (mg KOH/g) | 300 | 300 | 30 | 30 | 30 |
| Metal (Ca or Mg)/TBN (ppm/mg KOH/g) | 0.33 | 5.00 | 8.00 | 8.00 | 8.00 |
| (B) | | | | | |
| Phosphorus-based wear preventive*6 amount of P (ppm) | 350 | 350 | 250 | 500 | 100 |
| ZnDTP*7 amount of P (ppm) | — | — | — | — | — |
| Metal (Ca or Mg)/P (ppm/ppm) | 0.29 | 4.00 | 0.96 | 0.48 | 2.40 |
| Other additives*8 (wt %) | 10.0 | 10.0 | 10.0 | 10.0 | 10.0 |
| Coefficient of friction between metals | 0.138 | 0.168 | 0.163 | 0.45 | 0.136 |
| Wear preventing property (Shell-type four-ball test-wear) | | | | | |
| • wear mark diameter (mm) @ 1800 rpm, 80° C., 30 min., 35 kgf | 0.48 | 1.24 | 1.32 | 0.55 | 1.43 |

*1Solvent-refined paraffin mineral oil (kinematic viscosity of 4 $mm^2/s$ at 100° C.)
*2Ca alkylbenzenesulfonate with a total base value of 300 mg KOH/g
*3Ca alkylbenzenesulfonate with a total base value of 30 mg KOH/g
*4Ca alkylbenzenesalicylate with a total base value of 170 mg KOH/g
*5Mg alkylbenzenesulfonate with a total base value of 400 mg KOH/g
*6(monoalkyl/dialkyl mixed) acid phosphate
*7secondary alkyl ZnDTP
*8Wear preventive, ashless dispersant, antioxidant, viscosity index improver, metal deactivator, and antifoam agent added to as other additives each in a given amount In view of the examples and comparative examples, it will be apparent that when two essential additives including metal detergent (A) and phosphorus-based wear preventive (B) are formulated in such a way that a ratio between a content of a metal derived from the metal detergent (A) and a total base number and a ratio between the content of the metal derived from the metal detergent (A) and a content of phosphorus derived from the phosphorus-based wear preventive (B) are, respectively, defined in specified ranges, requirements for use as a lubricating oil for continuously variable transmission are satisfied in all the example, and high-quality oils are obtained.

On the other hand, in Comparative Examples 1–5 wherein although the metal detergent of component (A) and the phosphorus-based wear preventive of component (B) are formulated, the ratio between a content of a metal derived from the metal detergent (A) and a total base number, or a ratio between the content of the metal derived from the metal detergent (A) and a content of phosphorus derived from the phosphorus-based wear preventive (B) is not within a specified range, a high coefficient of friction between metals and an excellent wear preventing property are not obtained.

The lubricating oil composition for continuously variable transmission of the invention, particularly, the lubricating oil composition for push belt-type continuously variable transmission comprises specific two types of additives, i.e. metal detergent (A) and phosphorus-based wear preventive, formulated in a lubricating base oil, wherein a ratio between a content of a metal derived from the metal detergent (A) and a total base number and a ratio between the content of the metal derived from the metal detergent (A) and a content of phosphorus derived from the phosphorus-based wear preventive (B) are, respectively, defined in specified ranges. As a result, the composition ensures such excellent properties that both a high coefficient of friction between metals and an excellent wear preventing property relative to a belt and a pulley stand together.

What is claimed is:

1. A lubricating oil composition for continuously variable transmission of the type which comprises a lubricating base oil made of a mineral oil and/or a synthetic oil formulated with a metal detergent and a phosphorus-based wear preventive characterized in that a ratio between a content (ppm) of a metal derived from said metal detergent and based on the total weight of the lubricating oil composition and a total base number (mg KOH/g) ranges 0.75–4.5 (ppm/mg KOH/g), and a ratio between the content (ppm) of the metal derived from said metal detergent and a content of phosphorus derived from said phosphorus-based wear preventive ranges 0.5–2.0 (ppm/ppm).

* * * * *